US011613953B2

(12) United States Patent
Linklater et al.

(10) Patent No.: US 11,613,953 B2
(45) Date of Patent: Mar. 28, 2023

(54) WELL ABANDONMENT AND SLOT RECOVERY

(71) Applicant: Ardyne Holdings Limited, Aberdeen (GB)

(72) Inventors: James Linklater, Aberdeen (GB); Alan Fairweather, Aberdeen (GB); George Telfer, Aberdeen (GB); Michael Wardley, Aberdeen (GB)

(73) Assignee: ARDYNE HOLDINGS LIMITED, Aberdeen (GB)

( * ) Notice: Subject to any disclaimer, the term of this patent is extended or adjusted under 35 U.S.C. 154(b) by 82 days.

(21) Appl. No.: 17/263,719

(22) PCT Filed: Jul. 31, 2019

(86) PCT No.: PCT/GB2019/052138
§ 371 (c)(1),
(2) Date: Jan. 27, 2021

(87) PCT Pub. No.: WO2020/025948
PCT Pub. Date: Feb. 6, 2020

(65) Prior Publication Data

US 2021/0198967 A1 Jul. 1, 2021

(30) Foreign Application Priority Data

Aug. 1, 2018 (GB) ..... 1812533

(51) Int. Cl.
*E21B 31/16* (2006.01)
*E21B 31/20* (2006.01)
(Continued)

(52) U.S. Cl.
CPC ..... *E21B 31/16* (2013.01); *E21B 29/005* (2013.01); *E21B 31/20* (2013.01); *E21B 33/13* (2013.01); *E21B 34/10* (2013.01); *E21B 47/10* (2013.01)

(58) Field of Classification Search
CPC ..... E21B 10/322; E21B 17/06; E21B 29/005; E21B 31/16; E21B 31/20; E21B 33/13;
(Continued)

(56) References Cited

U.S. PATENT DOCUMENTS 6,629,565 B2 * 10/2003 Harrell ..... E21B 23/00 166/55.7
2002/0162659 A1 * 11/2002 Davis ..... E21B 47/095 166/361
2013/0048268 A1 * 2/2013 Crow ..... E21B 31/16 166/55.7
(Continued)

FOREIGN PATENT DOCUMENTS

GB 2548727 A 9/2017
GB 2556461 A 5/2018
(Continued)

OTHER PUBLICATIONS

Intellectual Property Office of the United Kingdom; Combined Search and Examination Report for GB1812533.6; dated Dec. 6, 2018; pp. 1-5; Intellectual Property Office of the UK Patent Office, Newport, United Kingdom.
(Continued)

*Primary Examiner* — Caroline N Butcher
(74) *Attorney, Agent, or Firm* — Law Office of Jesse D. Lambert, LLC

(57) ABSTRACT

A single trip casing cutting and pulling assembly which includes a casing spear (12), a mud motor (16) and a casing cutter (18), wherein a valve (14) is located between the casing spear (12) and the mud motor (16). The casing spear
(Continued)

is operated by fluid flow from surface and the valve (14) prevents operation of the casing cutter (18) until the casing spear (12) is set and casing cutting is required. A method is described for cutting and pulling casing which does not require any rotation of the drill string to operate any part of the casing cutting and pulling assembly. An embodiment is described which includes retrieving the seal assembly (48) on the same trip. Further embodiments describe performing an integrity test and a circulation test on the same trip with the option of making further cuts at shallower depths on the same trip until a section of cut casing can be recovered.

20 Claims, 6 Drawing Sheets

(51) Int. Cl.

| | |
|---|---|
| ***E21B 34/10*** | (2006.01) |
| ***E21B 47/10*** | (2012.01) |
| ***E21B 29/00*** | (2006.01) |
| ***E21B 33/13*** | (2006.01) |

(58) Field of Classification Search
CPC ..... E21B 34/10; E21B 34/14; E21B 4/02; E21B 47/10
See application file for complete search history.

(56) References Cited

U.S. PATENT DOCUMENTS

2017/0058632 A1* 3/2017 deBoer ..... E21B 33/143

FOREIGN PATENT DOCUMENTS

| | | | | |
|---|---|---|---|---|
| WO | WO-2016172736 A1 * | 10/2016 | ..... | E21B 34/10 |
| WO | WO 2016/205725 A1 | 12/2016 | | |
| WO | WO 2017/046613 A1 | 3/2017 | | |
| WO | WO 2018/083473 A1 | 5/2018 | | |

OTHER PUBLICATIONS

International Bureau of WIPO; International Preliminary Report on Patentability for PCT/GB2019/052138; dated Feb. 2, 2021; pp. 1-7; International Bureau of WIPO, Geneva, Switzerland.

* cited by examiner

WELL ABANDONMENT AND SLOT RECOVERY

The present invention relates to apparatus and methods for well abandonment and slot recovery and in particular, though not exclusively, to a single trip casing cutting and pulling assembly which can operate without rotation of the drill string from surface to facilitate removal of the seal assembly on the same trip.

When a well has reached the end of its commercial life, the well is abandoned according to strict regulations in order to prevent fluids escaping from the well on a permanent basis. In meeting the regulations it has become good practise to create the cement plug over a predetermined length of the well and to remove the casing. Current techniques to achieve this may require multiple trips into the well, for example: to pull the wear bushing from the wellhead; to pull the seal assembly from the wellhead; to set a bridge plug to support cement; to cut the casing above the plug; to pull the cut casing from the well; and create a cement plug to cement across to the well bore wall. The cement or other suitable plugging material forms a permanent barrier to meet the legislative requirements.

Each trip into a well takes substantial time and consequently significant costs. Combined casing cutting and pulling tools have been developed so that the cutting and pulling of the casing can be achieved on a single trip. Such a tool is the TRIDENT® System to the present Applicants, Ardyne Technologies Limited.

U.S. Pat. No. 6,629,565 to Smith International, Inc. discloses a well abandonment process and apparatus for cutting and retrieving an offshore well casing, the process comprising: making a trip to the well wherein all of the following steps are performed, the steps comprising: pulling a seal assembly from the wellhead, cutting the casing, griping the casing, and retrieving the seal assembly and cut casing. Thus this advantageously combines the steps of cutting and pulling the casing along with pulling the seal assembly to save a further trip into the well.

In U.S. Pat. No. 6,629,565 a casing cutting and pulling tool is suspended from an offshore vessel or platform by connection to a drill pipe. At the top of the casing cutting and pulling tool, there is a seal assembly retrieval tool mounted in the drill string, which is used to pull the seal assembly of interior casing or intermediate casing in a wellhead. Below the seal assembly retrieval tool, the casing cutting and pulling tool also has a bumper jar, a spear, a long stroke bumper jar, a mud motor and a casing cutter, all connected to each other in series in the order given.

In one embodiment, the procedure for operation of the system is as follows. Trip in the hole until the seal assembly retrieving tool is at the seal in the wellhead. It is important to allow for enough space out to trip seal assembly into riser. Next, engage the seal assembly with the seal assembly retrieval tool. Then pull the seal assembly and the casing cutting and pulling tool up into riser. The casing cutter is then spotted at the desired cutting depth. With the casing cutter in the correct location, a slight left-hand torque is applied to engage the spear (¼ turn) to grip the casing. The casing is then cut and the spear is disengaged by a right-hand torque to release its grip on the casing. The casing cutting and pulling tool is then pulled out of the hole until the spear is just below the wellhead. A left-hand torque is then applied to engage the spear to grip the casing. Next, the casing cutting and pulling tool is pulled out of the hole with the casing. The seal assembly and seal assembly retrieval tool are then laid out at the surface. The casing cutting and pulling tool is then pulled further out of the hole until the casing hanger is landed out on rotary table. It should be spaced out so that the spear can be racked in the derrick. The spear is then disengaged and racked back in the derrick. Finally, the casing is rigged up and laid down on the derrick.

Since the spear is engaged to grip the casing before the casing is cut with the casing cutter, the casing may be cut in tension. In particular, with the spear engaged, the operator of the casing cutting and pulling tool may pull up on the drill pipe so that the casing experiences an applied pressure in tension. With tension pressure applied to the casing during the cutting procedure, the chances of a successful cut are greatly increased. Once the seal assembly is pulled the casing may be cut with the spear at any depth below the wellhead.

In this arrangement the seal assembly must remain attached to and be supported by the drill string in the riser during cutting of the casing. This means that the drill string cannot be fully rotated from surface to rotate the cutting blades and cut the casing as any rotation could cause the seal assembly to detach from the retrieval tool. In U.S. Pat. No. 6,629,565, a mud motor is used to rotate the cutter with flow from surface through the drill string operating the motor and extending the cutter blades from a retracted position to an extended position. The casing spear must sit above the mud motor as such motors are limited in the pull which can be exerted through them, typically 200,000 to 250,000 lbs, which is less than that required to pull the cut casing. As the motor and blades are operated by pressure flow in the drill string, the casing spear is operated by an alternative means. In U.S. Pat. No. 6,629,565, the casing spear is operated by quarter turns. However, when used in deep water it is difficult to supply such manipulation of the drill string over the extended distance while ensuring that the seal assembly does not disengage from the seal assembly retrieval tool.

It is therefore an object of at least one embodiment of the present invention to provide a casing cutting and pulling assembly which obviates or mitigates one or more disadvantages of the prior art.

It is therefore an object of at least one embodiment of the present invention to provide a method of cutting and pulling casing on a single trip which obviates or mitigates one or more disadvantages of the prior art.

According to a first aspect of the present invention there is provided a casing cutting and pulling assembly located on a drill string comprising, in order, from surface:

a casing spear to anchor to casing in a well bore;

a mud motor operated by fluid flow through the drill string so as to rotate the drill string attached thereto;

a casing cutter configured to cut the casing, the casing cutter including a plurality of blades which move from a retracted position to an extended position on fluid pressure in the drill string;

characterised in that:

the casing spear is operated by fluid pressure in the drill string;

a valve is mounted in the drill string between the casing spear and the casing cutter, the valve limiting fluid pressure through the drill string to the casing cutter until the casing spear is anchored to the casing and cutting is required.

In this way, there is no requirement to rotate the drill string at surface to operate the casing spear. Additionally, the blades cannot be inadvertently extended and cut casing when the casing cutter is not at a desired position to cut the casing as the valve prevents sufficient fluid pressure reaching the blades.

Preferably, the valve is configured to limit fluid flow therethrough until a pre-determined fluid pressure is exceeded. The valve may remain closed until the pre-determined pressure is exceeded. In this way, the pre-determined pressure is selected to be greater than the fluid pressure required to set an anchor mechanism of the casing spear. Preferably, the valve is resettable. More preferably, the valve is resettable by stopping fluid flow through the drill string. In this way, the casing spear can be repositioned at a top of a cut section of casing and anchored thereto for the purpose of pulling the casing without fear that the suspended casing section will be cut below the spear.

The valve may be between the casing spear and the motor. Alternatively, the valve may be between the motor and the casing cutter. Any flow to the motor will operate the motor but it is immaterial if the motor turns at any time as cutting can only take place when the blades are extended and the motor is turning.

Preferably one or more additional tools are located on the drill string.

Preferably the one or more additional tools includes a seal assembly retrieval running tool configured to connect to a seal assembly in the well bore. Preferably the seal assembly retrieval running tool is located between surface and the casing spear. In this way, a seal assembly can be pulled on the same trip as cutting and pulling casing without rotation of the drill string which could release the seal assembly from the running tool.

Preferably, the one or more additional tools includes a packer. More preferably, the packer is a mechanical tension-set retrievable packer. In this way, the packer can be set by pulling or releasing tension on the drill string. Preferably, the casing spear is located between the mechanical tension-set retrievable packer and the casing cutter. In this way, casing can be cut under tension and pressure and/or circulation tests can be performed.

The one or more additional tools may include a second casing spear, the second casing spear being located closer to the running tool than the casing spear. In this way, the casing spear is used to anchor the drill string to the casing and stabilise the casing cutting tool while the second casing spear is used to pull the cut section of casing.

According to a second aspect of the present invention there is provided a method of cutting and pulling casing, the method comprising the steps:

(a) providing a casing cutting and pulling assembly according to the first aspect on a drill string;
(b) running the drill string through a wellhead location into a wellbore;
(c) locating the casing spear and casing cutter below the wellhead at a position at which casing is to be cut;
(d) increasing fluid pressure through the drill string to a first pressure to anchor the casing spear to the casing;
(e) further increasing fluid pressure through the drill string to a pre-determined pressure level, greater than the first pressure, to operate the valve;
(f) using fluid pressure below the valve to extend the blades of the casing cutter and cutting the casing by rotation via the mud motor;
(g) reducing the fluid pressure so as to retract the blades of the casing cutter;
(h) pulling the drill string so as to recover a cut section of casing.

In this way, the entire operation can be performed without the requirement to rotate the drill string.

Preferably, the method includes at step (g): releasing the casing spear from the casing; repositioning the casing spear towards an upper end of the cut section of casing; and, anchoring the casing spear to the upper end of the cut section of casing. Preferably the valve is reset so as to allow anchoring of the casing spear to the upper end of the cut section of casing without operation of the casing cutter. More preferably, the valve is reset by stopping pumping of fluid through the drill string.

The method may include the steps of mounting a seal assembly retrieval running tool to the drill string above the casing spear and pulling a seal assembly prior to cutting the casing, with the seal assembly being retrieved with the cut section of casing.

The method may include at step (g): releasing the casing spear from the casing; positioning a second casing spear towards an upper end of the cut section of casing; and, anchoring the second casing spear to the upper end of the cut section of casing. In this way, longer lengths of casing can be retrieved in shorter lengths of time. Additionally, the casing spear can be located close to the casing cutter to stabilise the casing cutter during cutting.

Preferably the method includes at step (a) locating a packer on the drill string above the casing spear. Preferably the method includes the further step of actuating the packer to seal an annulus between the drill string and casing in the well bore. Preferably the method includes the step of setting down weight on the drill string to set the packer. Alternatively the method includes the step of applying an upward force or tension to the drill string to set the packer. In this way, a mechanical tension-set packer may be used. The packer may be used to perform the integrity test.

Preferably the method includes the step of performing a circulation test to determine circulation behind the cut tubular at surface. This provides a positive circulation test and the cut casing section, can be removed. Preferably the circulation test is performed between steps (f) and (g). This provides the necessary access behind the cut tubular to determine if circulation occurs.

The method may include the further steps of pulling the drill string to locate the casing cutter at a shallower depth in the casing and cutting the casing at the shallower depth. This will be needed in the event that the circulation test is negative, there being no circulation behind the cut tubular.

The method may include repeating the circulation test and cutting casing at increasingly shallower depths until a positive circulation test occurs and a section of cut tubular can be removed from the wellbore.

In the description that follows, the drawings are not necessarily to scale. Certain features of the invention may be shown exaggerated in scale or in somewhat schematic form, and some details of conventional elements may not be shown in the interest of clarity and conciseness. It is to be fully recognized that the different teachings of the embodiments discussed below may be employed separately or in any suitable combination to produce the desired results.

Accordingly, the drawings and descriptions are to be regarded as illustrative in nature, and not as restrictive. Furthermore, the terminology and phraseology used herein is solely used for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited, and is not intended to exclude other additives, components, integers or steps. Likewise, the term "comprising" is considered synonymous with the terms "including" or "containing" for applicable legal purposes.

All numerical values in this disclosure are understood as being modified by "about". All singular forms of elements, or any other components described herein including (without limitations) components of the apparatus are understood to include plural forms thereof. Furthermore, relative terms such as", "lower", "upper, "up", "down" and the like are used herein to indicate directions and locations as they apply to the appended drawings and will not be construed as limiting the invention and features thereof to particular arrangements or orientations. Likewise, the term "inlet" shall be construed as being an opening which, dependent on the direction of the movement of a fluid may also serve as an "outlet", and vice versa.

There will now be described, by way of example only, various embodiments of the invention with reference to the drawings, of which:

FIGS. 1A to 1D provide schematic illustrations of a method according to an embodiment of the present invention;

Figure 1A:
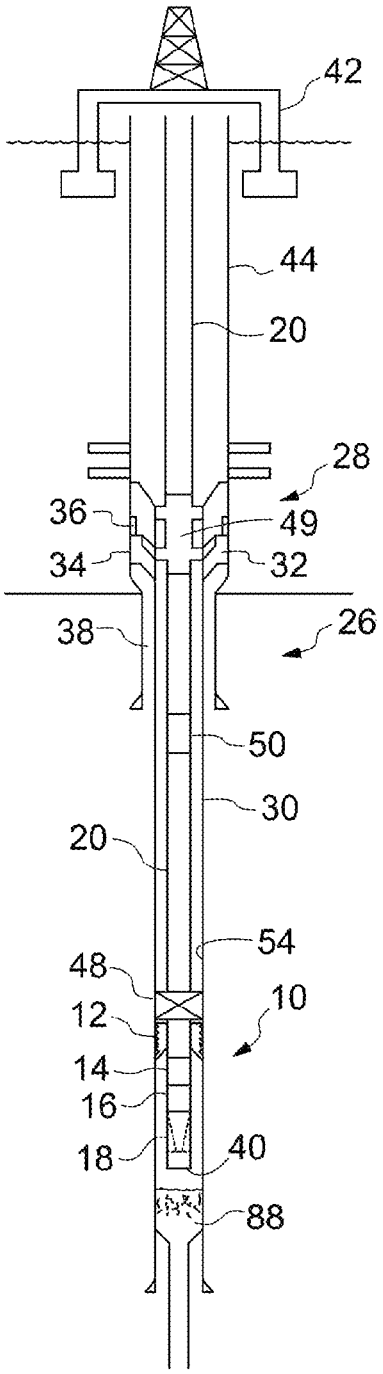

Referring to FIGS. 1A to 1D there is illustrated a casing cutting and pulling assembly, generally indicated by reference numeral 10, including a casing spear 12, a valve 14, a mud motor 16 and a casing cutter 18, mounted in order upon a drill string 20, according to an embodiment of the present invention.

The casing cutting and pulling assembly 10 is used to cut and remove a casing section 24 from a well 26. The well shown in FIGS. 1A to 1D is a typical arrangement in which a wellhead 28 provides access to a subsea well 26. For simplicity only two casings are shown, with an inner casing string 30 supported from a casing hanger 32 mounted in the wellhead housing 34. A seal assembly 36 is used to seal the annulus 38. Those skilled in the art will recognise that a wear bushing can be present to protect the seal assembly. This wear bushing may be removed in a separate trip before the method of the present invention is used or the wear bushing may be retrieved with the seal assembly. The drill string 20 is run from a rig/platform or vessel 42 through a riser 44 and further through the wellhead 28.

Further tools are mounted on the drill string 20. Above the assembly 10 is a packer 48. Packer 48 is preferably a mechanical tension-set packer which allows circulation tests to be performed when the casing 30 has been cut. At a higher position on the string is a second casing spear 50. The second casing spear 50 may be of the same design as the first casing spear 12 but is preferably one specifically designed to attach to the upper end 52 of a cut section of casing 24. In the present invention, the second casing spear 50 is the FRM Spear available from Ardyne Technologies Limited. Above the second casing spear 50 is a seal assembly retrieval running tool 49. Such running tools are specific to the seal assembly 36 present in the wellhead housing 34. The further tools are shown for illustrative purposes only and other combinations of downhole tools could be used with the assembly 10.

Figure 2A:
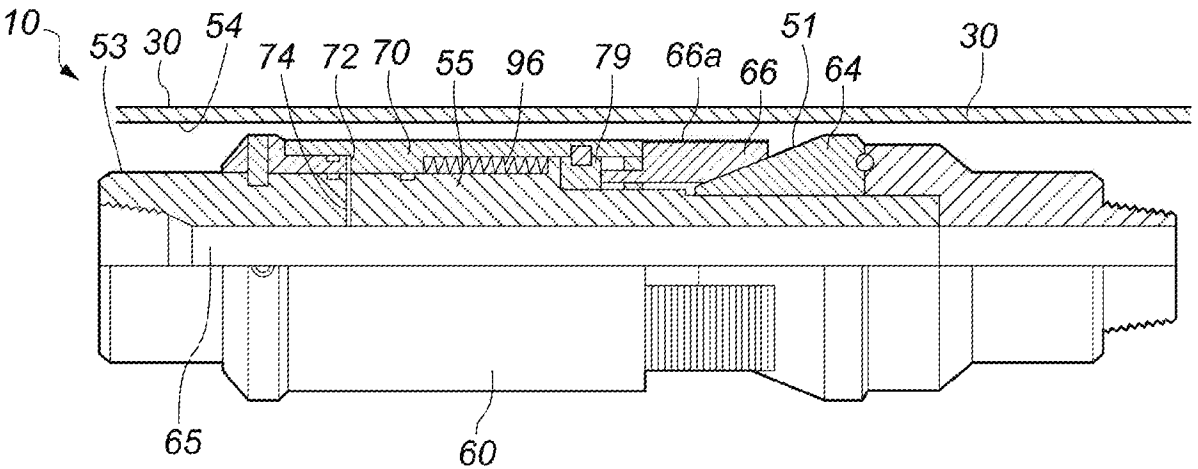
FIG. 2A is a sectional view of a casing spear of a casing cutting and pulling assembly in a run-in state according to an embodiment of the present invention.
Figure 2B:
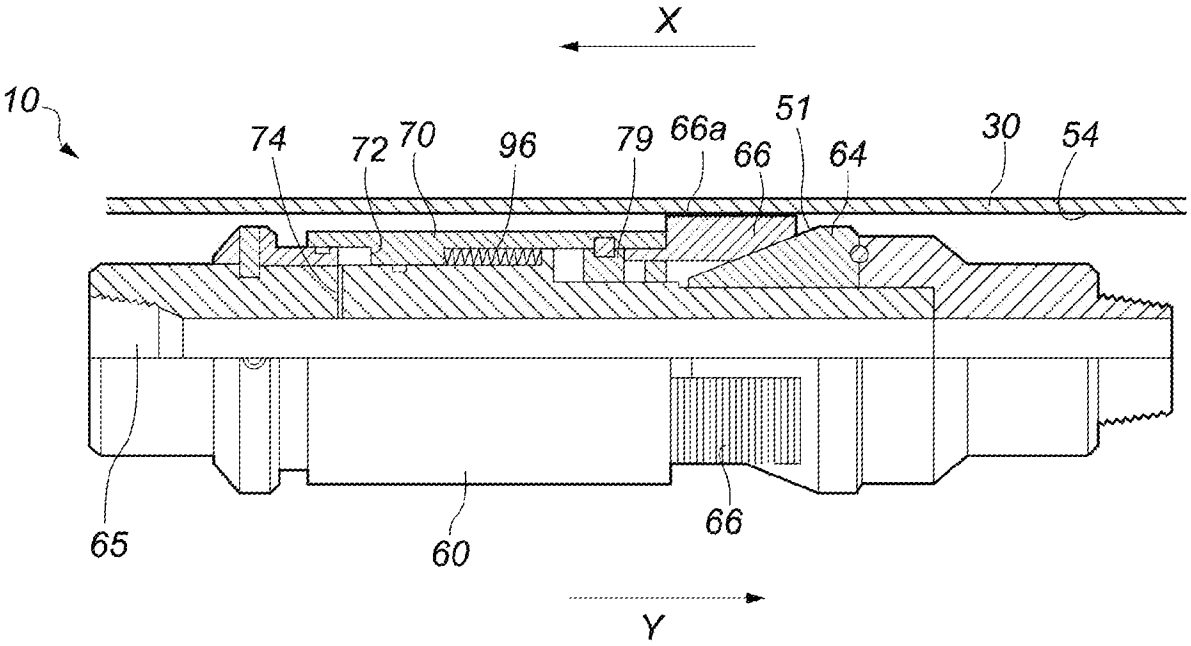
FIG. 2B is a sectional view of the casing spear of FIG. 2A in an operational state.

In the assembly 10, the casing spear 12 can be considered as an anchor mechanism 60. FIGS. 2A and 2B are enlarged longitudinal sectional views of an anchor mechanism 60 of the assembly 10 in accordance with a first embodiment of the invention. The assembly 10 has an elongate body 53 providing a mandrel 55 with a central bore 65 through which fluid is configured to be pumped.

The anchor mechanism 60 comprises a cone 64 circumferentially disposed about a section of the assembly 10. A plurality of slips 66 are configured to move along the surface of the cone 64. The slips 66 have a grooved or abrasive surface 66*a* on its outer surface to engage and grip the casing.

The slips 66 are configured to move between a first position shown in FIG. 2A on the cone 64 in which the slips 66 are positioned away from surface of the casing, and a second position in which the slips 66 engage the surface of the casing as shown in FIG. 2B.

The slips 66 are connected to a sleeve 70. The sleeve 70 is movably mounted on the body 53 and is biased in a first position by a spring 96 as shown in FIG. 2A. It will be appreciated that any spring, compressible member or resilient member may be used to bias the sleeve in a first position.

A shoulder 72 of the sleeve 70 is in fluid communication with the main assembly bore 65 via a flow path 74. The sleeve 70 is configured to move from a first sleeve position shown in FIG. 2A to a second fluid position shown in FIG. 2B when fluid is pumped into bore 65 above a pre-set circulation threshold through flow path 74 to apply fluid pressure to shoulder 72 of the sleeve 70. Thus by the application of fluid pressure in the central through bore, the slips 66 will engage the inner surface 54 of the casing 30.

If tension is applied by overpulling the drill string 20 and the assembly 10, the slips are further forced outwards to grip the inner surface 54 of the casing 30. This anchors the assembly 10 to the casing 30 and sets the anchor mechanism preventing accidental release. Changing fluid pressure through the anchor mechanism will not deactivate the slips. The slips and anchor mechanism will release when the tension is removed and weight is set down on the string 20.

The casing spear 12 is as described in WO2017046613 which is incorporated herein by reference. It will be apparent by those skilled in the art that other designs of fluid pressure operated casing spears could be used to anchor the drill string to the casing.

The casing cutter 18 may be any design in which the blades 73 are initially in a retracted position and then are moved to an expanded position to cut the casing by the flow of fluid through or increase of fluid pressure at the cutter 18. The casing cutter 18 may be as described in U.S. Pat. No. 6,629,565 which is incorporated herein by reference.

Between the casing spear 12 and the casing cutter 18 is a mud motor 16. The mud motor 16 is as well known in the art. Fluid flow through the motor turns one part with respect to another so that the drill string 20 or tool, such as the casing cutter 18, attached to the lower end of the motor will be rotated. The mud motor 16 will therefore rotate the drill string 20 and all tools mounted thereon below the mud motor 16. Thus the drill string 20 will be static above the mud motor 16. The mud motor 16 may be as described in U.S. Pat. No. 6,629,565 which is incorporated herein by reference.

Figure 3A:
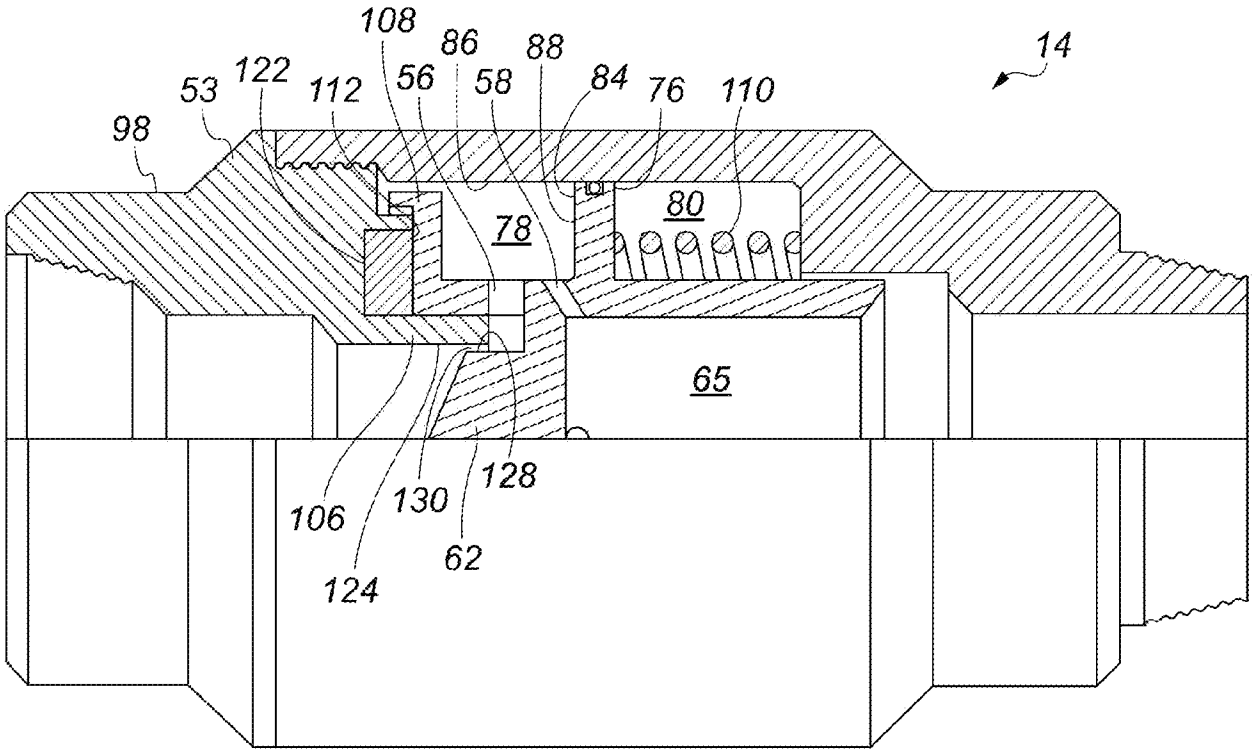
FIG. 3A is a sectional view of a valve of a casing cutting and pulling assembly in a first configuration according to an embodiment of the present invention.
Figure 3B:
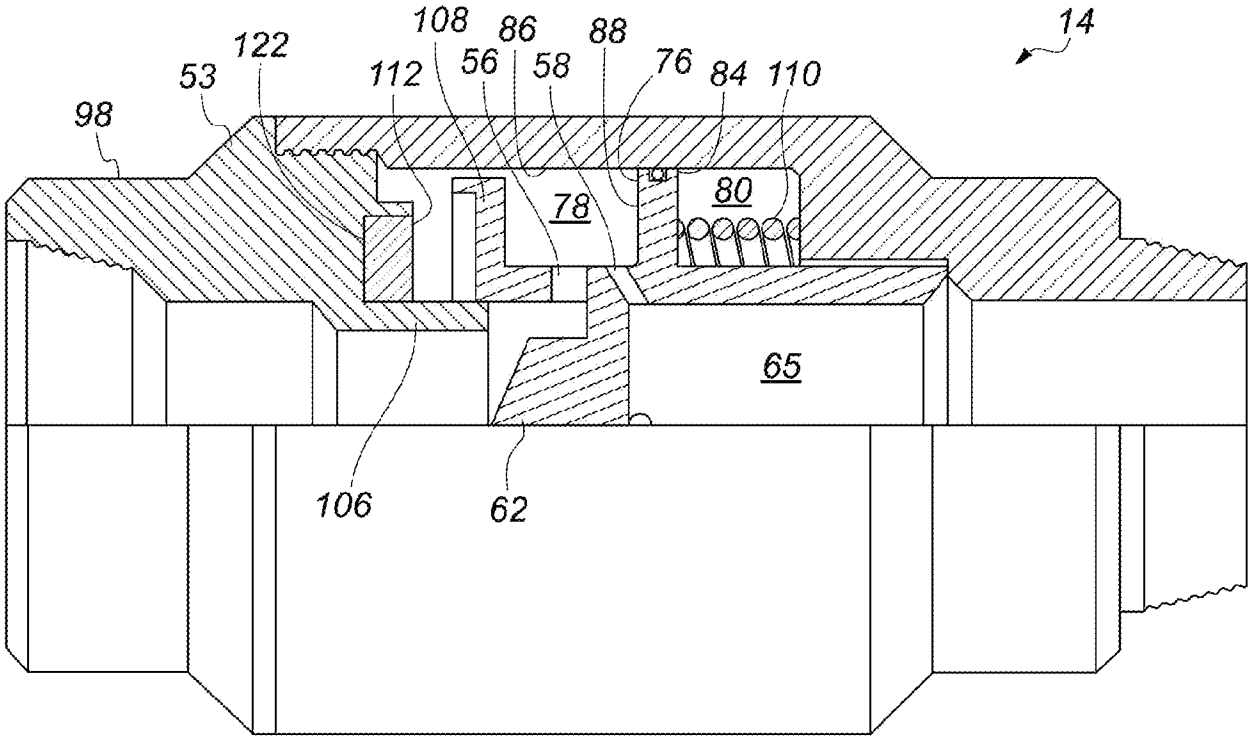
FIG. 3B is a sectional view of the valve of FIG. 3A in a second configuration.

Above the mud motor 16 and below the casing spear 12 is located a valve 14. Valve 14 is as illustrated in FIGS. 3A and 3B. Valve 14 has an elongate two-part body 53 with a piston sleeve 76 located within. The piston sleeve 76 provides two annular chambers 78,80 with a dividing wall 84 separating the chambers 78,80 which is sealed to the inner surface 86 of the body 53. The dividing wall 84 provides a piston area 88. The first chamber 78 has an inlet 56 and outlet 58 connecting the first chamber 78 to the central bore 65 around an elongate nipple 62 which lies coaxially with and obstructs the central bore 65. The second chamber 80 includes a spring 110 which is compressed when fluid pressure acts on the piston area 88.

The body 53 has an inner wall 106 towards an upper end 98 of the valve 14. An end of the piston sleeve 76 lies between the inner wall 106 and the inner surface 86, with an upper wall 108 of chamber 78 of the piston 76 being biased towards an inner face 112 of the body 53 between the inner wall 106 and the inner surface 86. The inner face 112 has a magnet 122 fixed thereon which holds the piston sleeve 76 against the body 53. In this arrangement an inner surface 124 of the inner wall 106 lies parallel to an outer surface 128 of the nipple 62. There is a relatively small gap 130 between the surfaces 124, 128 which restricts fluid flow through the valve 14, as this gap is smaller than the cross-sectional flow area of the inlet 56 and outlet 58 which are arranged below. This may be considered as a first configuration and is as shown in FIG. 3A.

The strength of the magnet 122 is selected to attract the piston sleeve 76 until a predetermined fluid pressure is exerted on the valve at the gap 130. This pre-determined pressure may be considered as the 'cracking pressure' which is when the pressure at the gap 130 is sufficient to push the piston sleeve 76 away from the magnet 122. Thus the predetermined pressure can be set within the valve 14 via the strength of the magnet 122 and the dimensions of the gap 130. Any tools located above the valve 14 can be operated at pressures up to the cracking pressure without operation of tools below the valve 14. When the piston sleeve 76 is moved away from the attraction of the magnet 122, the spring 110 is compressed as the piston sleeve 76 is moved downwards. Such movement shifts the nipple 62 clear of the inner wall 106 and fluid flow is increased through the valve 14 by virtue of travel through the inlet 56 to chamber 78 and onward exit to the central bore 65 through outlet 58. Fluid pressure below the valve 14 is now increased to operate tools below the valve 14. This may be considered as a second configuration and is shown in FIG. 3B. If fluid flow is stopped, the spring 110 will cause the piston sleeve 76 to move upwards until the sleeve 76 is attracted to the magnet 122 and is affixed thereto again. The valve 14 has returned to the first configuration. Thus the valve 14 is resettable. It will be noted that the spring 110 is relatively weak such that the magnetic force determines the cracking pressure. Once the magnetic force has been overcome, the pressure need to keep the valve 14 open is much less than the cracking pressure and is determined via the piston area 88 and the force of the spring 110. In this way, fluid flow can be varied through the valve 14 once the cracking pressure has been reached. This is in contrast to many spring operated valves which require a pressure equal to the cracking pressure to maintain the valve in an open position.

One example of a valve is described here, but it will be recognised that other designs of valves may be used to achieve the same objective. Valves referred to as flow-stop valves, for example, are known which are used in riserless drilling to avoid losing barrels of mud every time a pipe connection is broken due to u-tubing. WO2016/205725 describes such a circulation valve and is incorporated herein by reference.

As shown in FIG. 1A the drill string 20 has arranged thereon, in a preferred embodiment, from a first end 40, the casing and pulling assembly 10, a mechanical tension-set retrievable packer 48, a second casing spear 50 and a seal assembly retrieval running tool 49. The components of the casing and pulling assembly 10 are the casing cutter 18, the mud motor 16, the valve 14, and the anchor mechanism being the casing spear 12. These may be formed integrally on a single tool body or may be constructed separately and joined together by box and pin sections as is known in the art. Two parts may also be integrally formed and joined to the third part. Sections of drill pipe are used to space out the assembly 10 and tools on the drill string 20.

Referring to FIG. 1A, there is illustrated the well 26 into which the casing cutting and pulling assembly 10 has been run. The seal assembly 36 is in place on the wellhead 28 to seal the annulus 38 to the casing string 30. A cement plug 88 is shown in the casing string 30. The casing cutting and pulling assembly 10 has been run-in the well 26, through the wellhead 28 and into the casing string 30 until the seal assembly retrieval running tool 49 lands in the wellhead 28.

On landing in the wellhead housing 34, the running tool 49 will latch onto the seal assembly 36 with the seal assembly 36 remaining in position in the wellhead housing 34 maintaining the seal on the annulus 38. At this point a wellbore integrity test is performed using the casing spear 12 and the mechanical tension-set retrievable packer 48 as the seal assembly 36 is in place.

On run-in the valve 14 will be in the first configuration. Low volume of fluid is pumped through the string 20 from surface, which due to the gap 130 will generate sufficient pressure above the valve 14 to set the anchor mechanism 60 of the casing spear 12. The anchor mechanism 60 is hydraulically actuated to grip the casing surface 54 to secure the axial position of the assembly 10 in the wellbore. The fluid circulation rate through bore 65 is increased above the pre-set threshold rate. Referring to FIGS. 2A and 2B, fluid flows through flow path 74 and acts on shoulder 72 of the sleeve 70 in the anchor mechanism 60. The pre-set threshold is set by the spring force of spring 96. The pre-set threshold will be below the cracking pressure of the valve 14.

The fluid pressure of the fluid above the pre-set threshold overcomes the spring force of spring 96. The sleeve 70 moves along the longitudinal axis of the tool body 53 to the second position shown in FIG. 2A. A slip retaining ring 79 is secured to the sleeve 70 and is connected to the slips 66. The sleeve 70 and slip retaining ring 79 push the slips 66 along the slope 51 of cone 64.

The slips 66 extend outward and engage the surface 54 of casing 30. The slips provide friction to maintain the position of the assembly 10 within the casing.

The assembly 10 is then anchored to the casing 30 by reversibly setting the anchor mechanism 60. To set the anchor mechanism an upward tension or pulling force is applied to the drill string 20 as shown by arrow X in FIG. 2B. The tension or pulling force causes the slips to be wedged or locked between the surface of the cone 64 of the tool and the casing 30 of the wellbore. At this point the tool will remain at this location even if the fluid pressure in the bore 65 is stopped or reduced below the pre-set threshold.

With the anchor mechanism 60 set, a further tension or pulling force applied to the drill string 20 operates the mechanical tension-set retrievable packer 48 to seal the annulus 38. An integrity test can now be performed. This positive and negative pressure test will determine the integrity of the cement plug 88 and the casing 30 around it. This is as illustrated in FIG. 1A and the steps required are as known in the art.

If the integrity test is successful, then the casing 30 can be cut. The pumps at surface are stopped so that setting down weight on the drill string 20 will unset the packer 48 and the casing spear 12. To unset and release the anchor mechanism 60 a downward force is applied in the direction shown as "Y" in FIG. 2B which momentarily moves the cone 64 away from the slips 66 which is sufficient to allow the spring force of the spring 96 to pull the slips 66 along the slope 51 of the cone and away from the casing 30 to the first position shown in FIG. 2A.

As the flow rate has been kept low, fluid pressure increase to operate the casing spear 12 and in the drill string above the valve 14 is less than the cracking pressure through the valve 14, and the valve 14 has remained in the first configuration shown in FIG. 3A. Accordingly, with insignificant fluid flow the valve 14, the cutter blades 73 remain in the retracted position and there is no concern over the possibly cutting the casing at this time. Even if the small amount of flow through the gap 130 is sufficient to turn the mud motor 16, the blades 73 will still be retracted as there is insufficient fluid pressure to achieve this and thus no cutting can be done.

To cut the casing 30, the drill string 20 is raised to pull up the casing cutting and pulling assembly 10 and locate the blades 73 of the casing cutter 18 at a desired location to cut the casing 30. As the drill string 20 is raised the seal assembly retrieval running tool 49 will pull the seal assembly with it so that the seal assembly 36 is supported by the drill string 20 within the riser 44. Removal of the seal assembly 36 provides access to the annulus 38 at the wellhead housing 34 so that fluids can be circulated through the annulus 38.

At this position, the casing spear 12 is hydraulically actuated to grip the casing surface 54 to secure the axial position of the assembly 10 in the wellbore 26. This process is as described hereinbefore. Once the casing spear 12 is anchored, slightly higher volumes of fluid than used to set the anchor mechanism 60 are pumped from surface through the drill string 20. These higher volumes when pumped through the small gap 130 in the valve 14, generate a higher pressure which forces the sleeve 76 away from the magnet 122 and acts on the piston area 88 to compress the spring 110. When the cracking pressure is reached the sleeve 76 is released from the magnet 122 and the spring 110 compresses as the nipple 62 of the valve 14 moves downwards relative to the body 53. Much higher flow rates can now pass through the valve 14. The valve 14 is in the second configuration illustrated in FIG. 3B. Fluid pressure can be increased at the casing cutter 18 until it is sufficient to cause the blades 73 of the casing cutter 18 to move radially outwardly from the drill string 20 and contact the casing 30.

The increased flow will also operate the mud motor 16 rotating the drill string 20 below the mud motor 16 and with it the casing cutter 18.

If desired the pump rate can be reduced to regulate the speed of cutting. Reducing the flow rate will reduce the pressure in the valve 14 and the casing spear 12. However, if the flow rate causes the pressure in the valve 14 to drop below the cracking pressure this will not cause the valve 14 to move back to the first configuration as the spring 110 is selected to be relatively weak. In the casing spear 12, the action of pulling the drill string 20 to set the slips 66 prevents any change in flow rate through the anchor mechanism 60 from unsetting the slips 66.

Figure 1B:
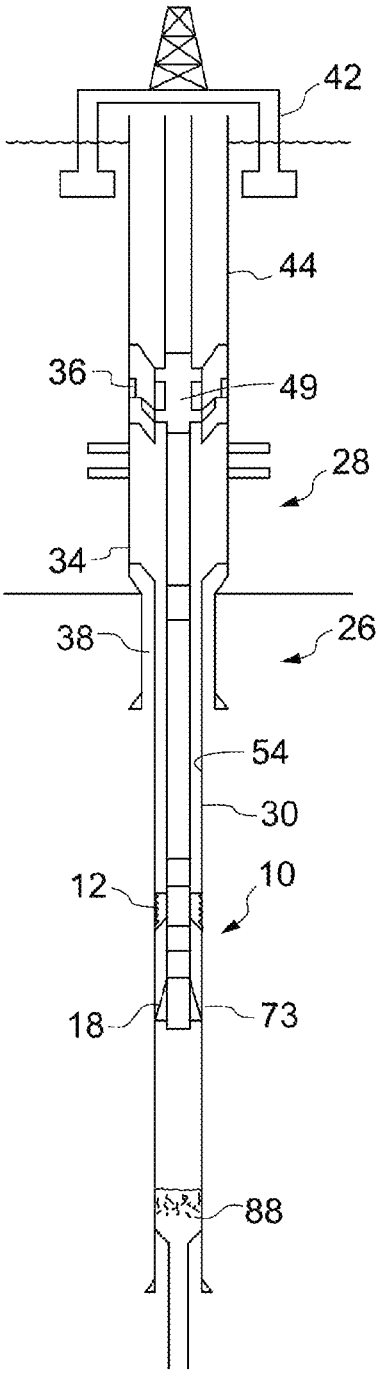

As the casing spear 12 is anchored to the casing 30, the casing can be held in tension during the cut. This is illustrated in FIG. 1B.

The use of a mechanically set retrievable packer 48 allows rapid setting of the packer 48 by pulling of the string 20 against the set casing spear 12, if a kick occurs in the well 26 for any reason. The mechanical tension-set retrievable packer 48 will rapidly set to seal the well 26 and is a safety feature. When the casing cutter 18 has finished cutting the casing 30, the casing cutter 18 is deactivated by stopping the pumps which removes fluid pressure to the blades 73 and they retract. We now have a cut section of casing 24 ready for removal.

At this point, the packer 48 can be set to seal the casing 30 and perform a circulation test since the annulus 38 is open. Fluid pressure applied through the drill string 20 will exit the casing at the cut 134 and can be detected in the annulus 38 at surface. The test can be performed with the blades 73 extended or retracted dependent on the fluid pressure used to perform the circulation test. A positive test indicates that the annulus behind the casing 30 is free of debris which may cause the casing 30 to stick when removed.

Figure 1C:
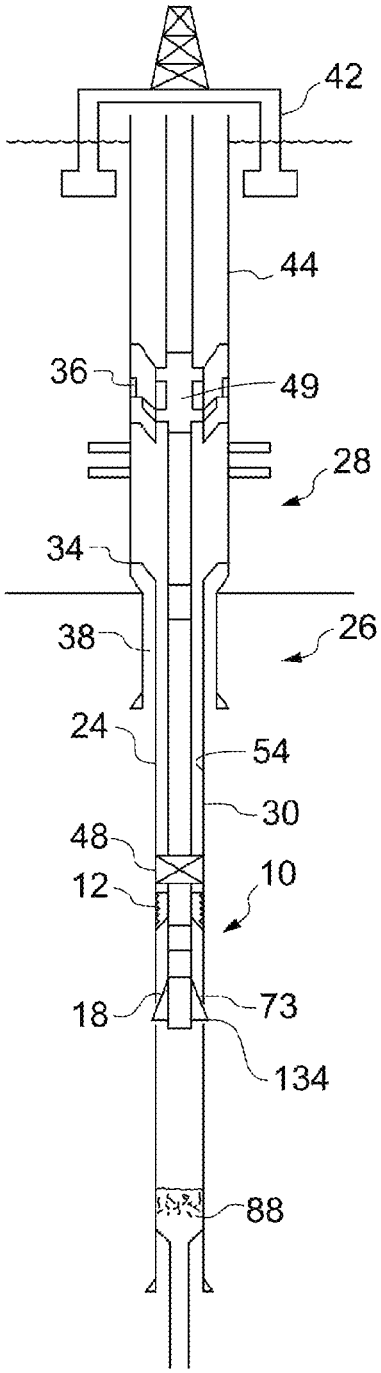

The cut casing section 30 can now be removed. This is as illustrated in FIG. 1C.

Figure 1D:
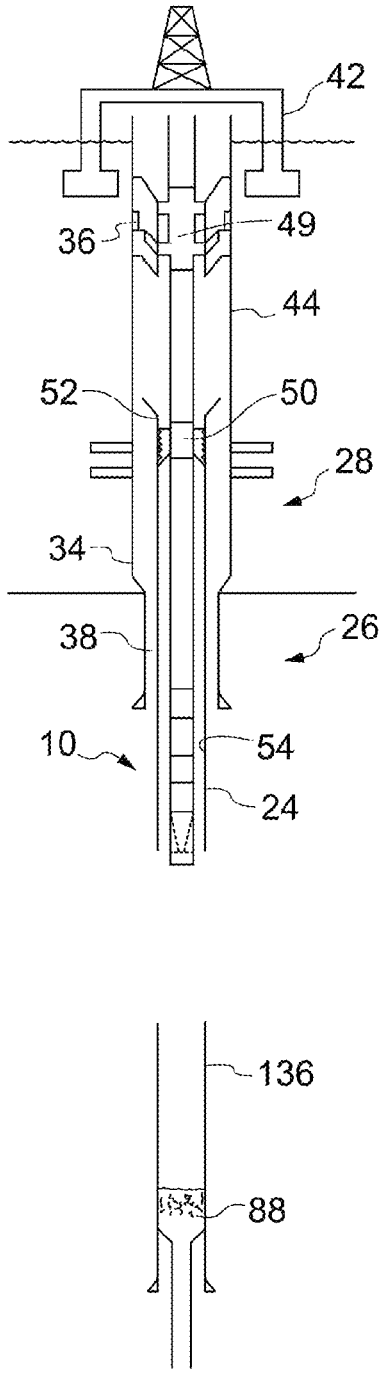

Tension applied to the drill string 20 is released to thereby unset the packer 48. The casing spear 12 is released by setting down weight on the drill string 20 as described hereinbefore. The pumps are stopped so that the fluid pressure through the valve 14 is dropped to zero and consequently the spring 110 will now return the sleeve 76 towards the magnet 122, whereupon it will be attracted to and attach to the magnet 122, resetting the valve 14 to the first configuration shown in FIG. 3A. The drill string 20 is now pulled out of the well 26 to locate the second casing spear 50 at an upper end 52 of the cut section of casing 24. In this position the casing spear 50 is activated to grip the casing section 24 and by pulling the drill string 20 and the casing cutting and pulling assembly 10 from the well 26, the seal assembly 36 is retrieved together with the cut section of casing 24. This is illustrated in FIG. 1D. The wellbore now contains the casing stub 136 and cement plug 88. The entire procedure has been completed on a single trip and without rotation of the drill string 20 from surface.

Additionally, if the second casing spear 50 is also pressure activated, the valve 14 will prevent the casing cutter 18 being activated as long as the pressure required is below the cracking pressure of the valve 14.

In the event that the circulation test is negative, that is a pressure increase is not seen at surface, then it is assumed that cement or other debris is located in the annulus between the cut casing 24 and the formation which will prevent movement and subsequent recovery of the cut casing section 24. The drill string 20 and casing cutting and pulling assembly 10 are then pulled up the casing to locate the blades 73 of the casing cutter 18 at a location higher in the well, shallower depth, on the cut casing section 24. The steps of cutting, testing and pulling can be repeated safe in the knowledge that the seal assembly 36 remains suspended from the drill string 20 in the riser 44 without fear that it will become detached from the running tool 49.

While a second casing spear 50 is described in the method to pull the cut section of casing 24, the casing spear 12 could alternatively be used to also pull the cut section of casing 24.

There also exists a second embodiment of the cutting and pulling assembly 10 in which the valve 14 sits between the mud motor 16 and the casing cutter 18. This operates in an identical manner to the first embodiment as described herein. Fluid pumped down the string to increase fluid pressure at the casing spear 12, will turn the mud motor 16 at least initially. Rotation of the tools below the motor 16 does not cause any problems as they are all fluid pressure actuated and the valve 14 prevents any fluid pressure being developed below the valve 14. Cutting of casing 30 requires the combined action of the blades 73 to be in an extended configuration and the motor 16 turning the string 20. One without the other will not provide cutting.

The principle advantage of the present invention is that it provides a robust and reliable casing cutting and pulling assembly which does not require rotation from surface to operate and ensures the casing cutter cannot be activated until required.

A further advantage of at least one embodiment of the present invention is that it provides a method of casing cutting and pulling on a single trip which retrieves the seal assembly on the same trip.

The foregoing description of the invention has been presented for the purposes of illustration and description and is not intended to be exhaustive or to limit the invention to the precise form disclosed. The described embodiments were chosen and described in order to best explain the principles of the invention and its practical application to thereby enable others skilled in the art to best utilise the invention in various embodiments and with various modifications as are suited to the particular use contemplated. Therefore, further modifications or improvements may be incorporated without departing from the scope of the invention herein intended. For example, it will be appreciated that the non-essential method steps may be added to, changed or removed for a single trip.

The invention claimed is:

1. A casing cutting and pulling assembly for location on a drill string comprising, in order, from surface:

a casing spear to anchor to casing in a well bore;

a mud motor operated by fluid flow through the drill string so as to rotate the drill string and all tools mounted thereon below the mud motor;

a casing cutter configured to cut the casing, the casing cutter including a plurality of blades which move from a retracted position to an extended position on fluid pressure in the drill string;

characterised in that:

the casing spear is operated by fluid pressure in the drill string;

a valve is mounted in the drill string between the casing spear and the casing cutter, the valve limiting fluid pressure through the drill string to the casing cutter until the casing spear is anchored to the casing.

2. A casing cutting and pulling assembly according to claim 1 wherein the valve is configured to limit fluid flow therethrough until a pre-determined fluid pressure is exceeded in the valve.

3. A casing cutting and pulling assembly according to claim 2 the valve remains closed until the pre-determined pressure is exceeded.

4. A casing cutting and pulling assembly according to claim 2 wherein the pre-determined pressure is selected to be greater than a fluid pressure required to set an anchor mechanism of the casing spear.

5. A casing cutting and pulling assembly according to claim 2 wherein the pre-determined pressure is greater than an operating pressure through the valve.

6. A casing cutting and pulling assembly according to claim 1 wherein the valve is resettable.

7. A casing cutting and pulling assembly according to claim 6 wherein the valve is resettable by stopping fluid flow through the drill string.

8. A casing cutting and pulling assembly according to claim 1 wherein one or more additional tools are located on the drill string, and the one or more additional tools includes a seal assembly retrieval running tool configured to connect to a seal assembly in the well bore, the seal assembly retrieval running tool being located between surface and the casing spear.

9. A casing cutting and pulling assembly according to claim 1 wherein one or more additional tools are located on the drill string, and wherein the one or more additional tools includes a packer.

10. A casing cutting and pulling assembly according to claim 9 wherein the packer is a mechanical tension-set retrievable packer and the casing spear is located between the packer and the mud motor.

11. A casing cutting and pulling assembly according to claim 1 wherein one or more additional tools are located on the drill string, and wherein the one or more additional tools includes a second casing spear, the second casing spear being located closer to the running tool than the casing spear.

12. A method of cutting and pulling casing, the method comprising the steps:

(a) providing a casing cutting and pulling assembly on a drill string, said casing cutting and bulling assembly comprising, in order, from surface:

a casing spear to anchor to casing in a well bore;

a mud motor operated by fluid flow through the drill string so as to rotate the drill string and all tools mounted thereon below the mud motor;

a casing cutter configured to cut the casing, the casing cutter including a plurality of blades which move from a retracted position to an extended position on fluid pressure in the drill string;

characterised in that:

the casing spear is operated by fluid pressure in the drill string;

a valve is mounted in the drill string between the casing spear and the casing cutter, the valve limiting fluid pressure through the drill string to the casing cutter until the casing spear is anchored to the casing;

(b) running the drill string through a wellhead location into a wellbore comprising casing;

(c) locating the casing spear and casing cutter below the wellhead at a position at which the casing is to be cut;

(d) increasing fluid pressure through the drill string to a first pressure to anchor the casing spear to the casing;

(e) further increasing fluid pressure through the drill string to a pre-determined pressure level, greater than the first pressure, to operate the valve;

(f) using fluid pressure below the valve to extend the blades of the casing cutter and cutting the casing by rotation via the mud motor;

(g) reducing the fluid pressure so as to retract the blades of the casing cutter;

(h) pulling the drill string so as to recover a cut section of the casing.

13. A method of cutting and pulling casing according to claim 12 wherein the method includes at step (g): releasing the casing spear from the casing; repositioning the casing spear towards an upper end of the cut section of casing; and, anchoring the casing spear to the upper end of the cut section of casing.

14. A method of cutting and pulling casing according to claim 13 wherein the valve is reset so as to allow anchoring of the respective casing spear to the upper end of the cut section of casing without operation of the casing cutter.

15. A method of cutting and pulling casing according to claim 12 wherein the method includes at step (g): releasing the casing spear from the casing; positioning a second casing spear towards an upper end of the cut section of casing; and, anchoring the second casing spear to the upper end of the cut section of casing.

16. A method of cutting and pulling casing according to claim 14 wherein the valve is reset by stopping pumping of fluid through the drill string.

17. A method of cutting and pulling casing according to claim 12 wherein the method includes reducing the pump rate after the valve has been operated.

18. A method of cutting and pulling casing according to claim 12 wherein the method includes the steps of mounting a seal assembly retrieval running tool to the drill string above the casing spear and pulling a seal assembly prior to cutting the casing, with the seal assembly being retrieved with the cut section of casing.

19. A method of cutting and pulling casing according claim 12 wherein the method includes at step (a) locating a packer on the drill string above the casing spear and the method includes the further step of actuating the packer to seal an annulus between the drill string and casing in the well bore and performing an integrity test before the casing is cut.

20. A method of cutting and pulling casing according to claim 12 wherein the method includes the step of performing a circulation test to determine circulation behind the cut tubular at surface.

* * * * *